United States Patent [19]

Tesa et al.

[11] Patent Number: 4,893,822

[45] Date of Patent: Jan. 16, 1990

[54] ELECTRONIC THROWING DART FOOTBALL

[76] Inventors: J. Rudolph Tesa; George Spector, both of 23 Broadway, Rm. 3615, New York, N.Y. 10007

[21] Appl. No.: 635,432

[22] Filed: Jul. 27, 1984

[51] Int. Cl.[4] ..... F41J 5/02

[52] U.S. Cl. ..... 273/376; 273/409

[58] Field of Search ..... 273/94, 321, 374, 376, 273/378, 379, 394, 407, 409, 410, 416

[56] References Cited

U.S. PATENT DOCUMENTS

| | | | |
|---|---|---|---|
| 2,074,850 | 3/1937 | McCullough et al. | 273/410 |
| 2,200,456 | 5/1940 | Shultz | 273/374 |
| 3,424,460 | 1/1969 | Simpson | 273/409 |
| 4,057,251 | 11/1977 | Jones et al. | 273/376 |
| 4,093,223 | 6/1978 | Wilke et al. | 273/54 R |

*Primary Examiner*—Edward M. Coven

[57] ABSTRACT

An electronic throwing dart football game is provided and consists of a combination of a dart board and football game. When a dart is thrown at the dart board the score on the dart board is automatically electrically transmitted by electric circuit routers to a score board and the position of the football is indicated on the football field by yard indicating lamps.

2 Claims, 1 Drawing Sheet

HM 30 VIS 14 BALL HM ON VIS 20 YD LINE
TD 10 20 30 40 50 40 30 20 10 TD
VIS
HM

VIS LAMPS
VIS BALL LOCATION
VIS SCORE COUNTER
ELECTRIC CIRCUIT ROUTER
VIS SWITCH
ELECTRIC CONDUCTORS MATRIX
DART BOARD CONTACTS
ELECTRIC CIRCUIT ROUTER
HM SWITCH
POWER SUPPLY
HM LAMPS
HM BALL LOCATION
HM SCORE COUNTER

ELECTRONIC THROWING DART FOOTBALL

BACKGROUND OF THE INVENTION

The instant invention relates generally to the game of darts and more specifically it relates to an electronic throwing dart football game.

Darts or darting is played by two dartists or teams of from two to eight. Darts are scored on point of entry on the board face. Of the clock-face games, tournament darts is the most popular. Other games include round-the-clock, all-fires, baseball, high score, cricket, 51-in-5's, 14-stop, killer, Mulligan, 301, sudden death and shanghai.

The invention is a game which involves only two players, both competing against each other like a regular dart game, except it is electronic football played through the use of darts. The object of the game is to score touchdowns or points, with each player representing the quarterback of their team. The dart represents the football; when it strikes one of the pie shaped score pieces or the touchdown bulls-eye piece of the dart board it automatically registers on a contact located on the back of each pie shaped pliece or bulls-eye piece. This is transferred to the scoreboard which keeps the players aware of all the situations such as score, time and the yard line the ball is on. It is also transferred to yard indicating lamps on a football field playing board to indicate positions of the football.

SUMMARY OF THE INVENTION

A principle object of the present invention is to provide an electronic throwing dart football game that combines the game of darts with the game of football, to enhance the entertainment qualities of the game for the players.

Another object is to provide an electronic throwing dart football game that has an electronic circuitry that will automatically transfer from the dart board to the score board all of the situations of the football game such as score, time and the yard line the ball is on.

An additional object is to provide an electronic throwing dart football game that utilizes impact football shaped darts designed for best wear and tear on the dart board.

A further object is to provide an electronic throwing dart football game that is simple and easy to use.

A still further object is to provide an electronic throwing dart football game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
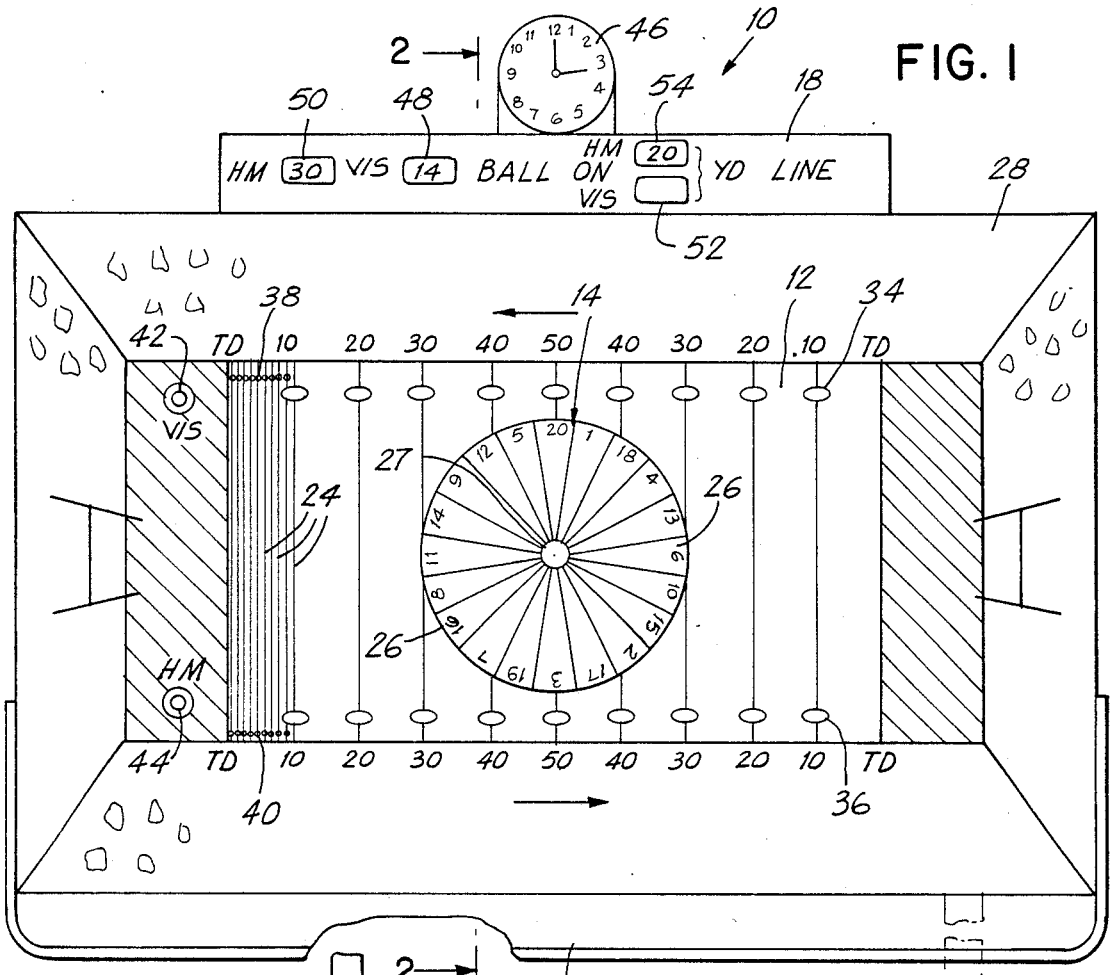
FIG. 1 is a front view of the invention.

Turning now descriptively to the drawings, in which similar reference characters denote similar elements throughout the several views, FIGS. 1 through 4 illustrates an electronic throwing dart football game 10 that consists of a vertical football playing field board 12, a dart board 14, a plurality of contact members 16, a score board 18, a plurality of darts 20 and devices **22*a* and 22*b***.

The football playing field board 12 has a plurality of yard indicating lines 24. The dart board 14 has a plurality of spring loaded pie shaped scoring pieces 26 and a touchdown bulls-eye piece 27. The dart board 14 is mounted in center of the football playing field board 12. Each contact member 16 is located on back of each pie shaped scoring piece 26 and the touchdown bulls-eye piece 27 while the scoreboard 18 is mounted above the football playing field board 12. The darts 20 are to be thrown by players at the dart board 14 to make contact with the pie shaped scoring pieces 26 and the touchdown bulls-eye piece 27 to activate the contact members 16.

The devices **22*a* and 22*b* are for carrying information electronically between the activated contact members 16 and the scoreboard 18 to automatically register and display the information on the scoreboard 18** indicate to the players the status of play of the football game.

The electronic throwing dart football game 10 further consists of a recessed frame 28 mounted around the football playing field board 12 and a basket 30 mounted along bottom of the recessed frame 28. The basket 30 is designed for catching the darts 20 that do not make contact and fall down. A pair of legs 32 can support the electronic throwing dart football game 10 instead of mounting it on a wall (not shown).

Figure 3:
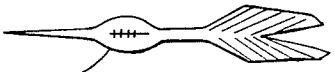
FIG. 3 is a side view of a football shaped dart.
Figure 2:
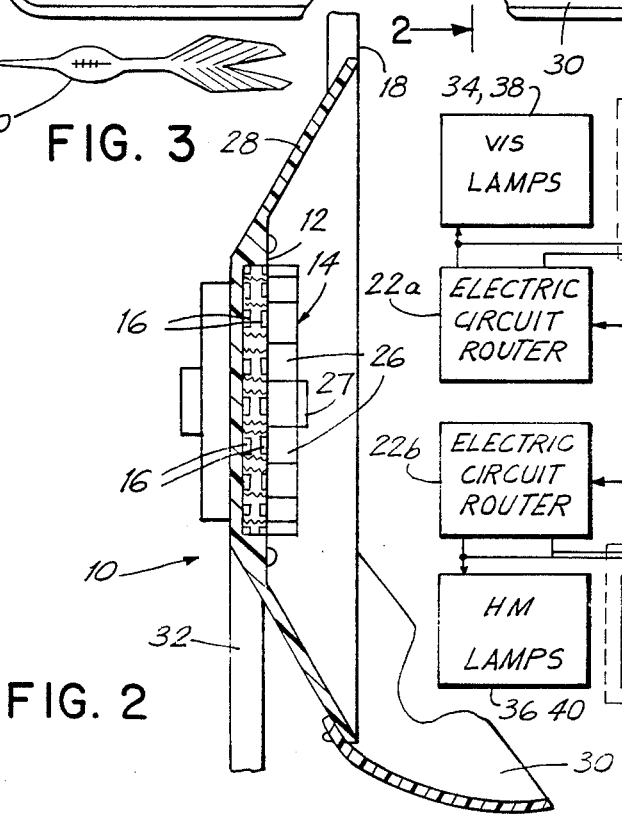
FIG. 2 is a cross sectional view taken along line 2—2 in FIG. 1 showing the contacts behind the dart board.

The dart 20 shown in FIG. 3 is an impact football shaped dart. It is designed for best wear and tear on the dart board 14.

The football playing field board 12 further contains two sets of ten yard football shaped indicating lamps 34 and 36, two sets of intermediate yard round shaped indicating lamps 38 and 40 and two switches 42 and 44.

One set 34 of the ten yard football shaped indicating lamps 34 are placed above the dart board 14 on each ten yard indicating line 24 for the visiting team. The other set 36 of the ten yard football shaped indicating lamps 36 are placed below the dart board 14 on each ten yard indicating line 24 for the home team.

One set 38 of the intermediate yard round shaped indicating lamps are placed above the dart board 14 on each intermediate yard indicating line 24 for the visiting team. The other set 40 of the intermediate yard round shaped indicating lamps are placed below the dart board 14 on each intermediate yard indicating line 24 for the home team.

Switch 42 is for the visiting team and controls the set 34 of the ten yard football shaped indicating lamps and the set 38 of the intermediate yard round shaped indicating lamps. Switch 44 is for the home team an controls the set 36 of the ten yard football shaped indicating lamps and the set 40 of the intermediate yard round shaped indicating lamps.

The devices **22*a* and 22*b* are also for carrying information electronically between the activated contact members 16 and the ten yard football shaped indicating lamps 34 and 36 and the intermediate yard round shaped indicating lamps 38 and 40 to automatically display the information on the football playing field board 12 to indicate to the players the position of the football on the football playing field board 12**.

The score board 18 consists of a time clock 46, a pair of score counters 48 and 50 and a pair of ball location indicators 52 and 54. The score counter 48 and ball location indicator 52 and 54. The score counter 48 and ball location indicator 52 is for the visiting team. The score counter 50 and ball location indicator 54 is for the home team.

Figure 4:
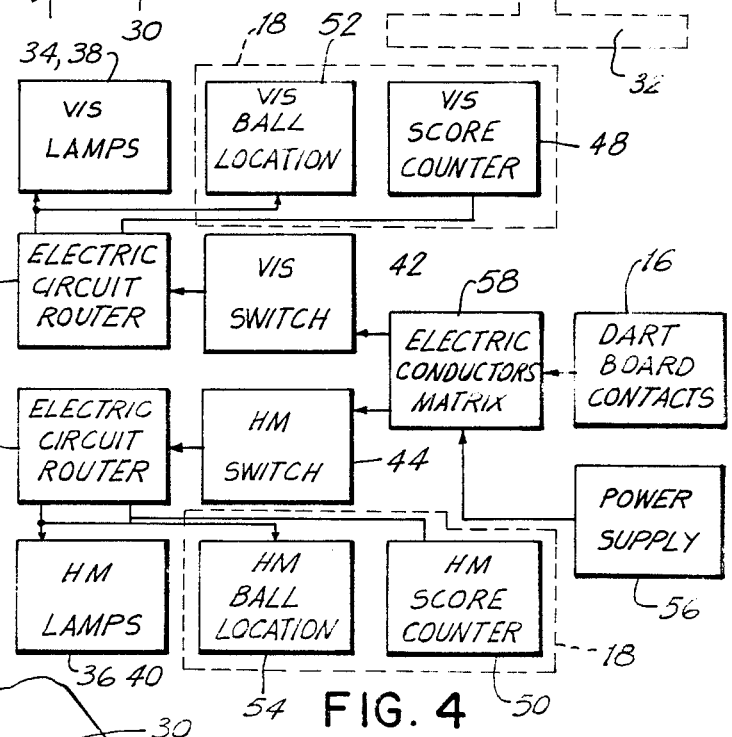
FIG. 4 is a simplified block diagram of the electrical components therein.

The devices **22*a* and 22*b* are a pair of electric circuit routers and will be best understood with reference to FIG. 4**. Since the circuitry is the same for the visiting team as the home team the visiting team circuitry is explained as follows.

The visitor switch 42 is turned on while the home switch 44 is turned off. A dart 20 is thrown at the dart board 14 to activate one of the dart board contacts 16. Power supply 56 will activated the circuit through electric conductor matrix 58, through the visitor switch 42 and electric circuit router **22*a***.

The electric circuit router **22*a* will light one of the visitor indicator lamps 34, 38 and indicate on the score board 18 on the visitor ball location 52 on what yard line the football is located and when needed the electric circuit router 22*a* will also indicate the score on the visitor score counter 48**.

To reverse the circuit the visitor switch 42 is turned off while the home switch 44 is turned on. Now the home team circuit will operate in the same manner as the visiting team circuit.

AN EXAMPLE OF HOW THE GAME IS PLAYED

The visiting team (player) gets the ball at his own 40 yard line. He must maintain control of the ball by throwing the dart 20 to receive a "10" or more or a touchdown. If at any time he hits under a "10" he loses control and his opponent, the home team (player) takes over the ball at the yard line the visiting team ends up at.

If the visiting team (player)first throw hits the touchdown bulls-eye piece 27, he receives a touchdown automatically. If his first throw hits the pie shaped scoring piece 26 numbered 5 he has his first down or the equivalent to throwing a "10" or more. The ball is now on the home team's 45 yard line. This is because midfield is the 50 yard line and the yardage reverses itself down to "0" which is the goal line or touchdown.

The visiting team (player) throws the dart 20 again, hits a "20" and is now on the home team's 25 yard line. He throws the dart again because he has hit a "10" or more to maintain possession. The dart 20 hits a "10" and he is at the home team's 15 yard line. Since the highest number on the dart board 14 is a "20" he has a good chance for the touchdown on his next throw of the dart.

The visiting team (player) throws the dart 20 again, hits a "7" and is now on the home team's 8 yard line. Once the player lands on the 10 yard line or less the rules change. To receive a touchdown the visiting team (player) must hit either the touchdown bulls-eye piece 27 or an eight or more. In order that it should not be too easy to score a touchdown within the 10 yard line, the highest number to score a touchdown can be limited. For example when on the 8 yard line the highest number to score a touchdown can be limited to number 15. In such a case to score from the 10 yard line the highest number can be 16 because it should be easier to score from the 8 yard line than the 10 yard line. The limiting number from other locations in the 10 yard zone are correspondingly preset and will be automatically indicated on the scoreboard corresponding to the ball location.

Obviously if you hit a number less than the yard line the ball is located, you do not score.

The size of the pie shaped portions on the dart board can be varied inversely to the point number and penalty zones can also be provided.

OTHER SPECIFICS OF THE GAME

1. Point after touchdown. By hitting the numbers "20" and "1" which are located side by side on the dart board 14.

2. Field goal. Same as point after touchdown but can be tried only if you are within 60 yards of your opponents goal line.

3. Bomb or touchdown in one throw. Achieved by hitting the touchdown bulls-eye piece 27 any time, from any yard line.

4. Punt. From any point on the field hit a "20" and your punt is a 40 yard punt. Double any number and that is the yardage.

This game may be played by keeping score manually according to the point system used in conventional darts whereby the points scored are used to compute the ball position and can be indicated by a light or moveable indicator like a pin. This game may be also adapted for video games whereby joy sticks control the flight of the darts and the football scores are automatically displayed electronically.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A throwing dart football game which comprises :

(a) a vertical football playing field board having a plurality of yard indicating lines;

(b) a dart board having a plurality of moveable spring loaded pie shaped scoring pieces and a touchdown bulls-eye piece activated by a dart, said dart board is mounted in center of said football playing field board;

(c) a plurality of contact members, each said contact member is located on back of each said pie shaped scoring piece and said touchdown bulls-eye piece;

(d) a score board mounted above said football playing field board;

(e) a plurality of darts to be thrown by players at said dart board to make contact with said pie shaped scoring pieces and said touch-down bulls-eye piece thereby activating said contact members;

(f) means responsive to activation of contact members for carrying information between said activated contact members and said score board and automatically registering and displaying said information on said score board to indicate to said players the status of play of said football game, said means including a spaced pair of aligned indicators on each side of the board indicating ball positions and including score indicators coordinated with the ball positions and information conveyed as a result of a thrown dart hitting a particular scoring piece;

(g) two sets of intermediate yard round shaped indicating lamps one said set placed above said dart board on each said intermediate yard indicating line for one team and other said set placed below said dart board on each said intermediate yard indicating line for other team;

(h) two switches mounted to said football playing field board, each said switch to control one said set of ten yard football shaped indicating lamps and one said set of intermediate yard round shaped indicating lamps; and (i) means for carrying information electronically between said activated contact members and said ten yard football shaped indicating lamps and said intermediate yard round shaped indicating lamps to automatically display said information on said football playing field board to indicate to said players the position of football on said football playing field board and the score after each dart is thrown.

2. An electronic throwing dart football game as recited in claim 1, wherein said means for carrying information electronically between said activated contact members and said score board and said means for carrying information electronically between said activated contact members and said ten yard football shaped indicating lamps being a pair of electric circuit routers, one said electric circuit router for each said player, further including means for varying the difficulty of scoring when the ball is inside a predesignated yard line.

* * * * *